US008323161B2

(12) United States Patent
Berens et al.

(10) Patent No.: US 8,323,161 B2
(45) Date of Patent: Dec. 4, 2012

(54) TONER ADDER BRUSH ROLLER AND METHOD FOR CONTROLLED INSTALLATION OF BRUSH FILAMENT POPULATION

(75) Inventors: Jenny Marie Berens, Lexington, KY (US); Leea Danielle Haarz, Lexington, KY (US); Edwina Floyd Lowry, Lexington, KY (US); Kathryn Dowlen Mullins, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1016 days.

(21) Appl. No.: 12/340,934

(22) Filed: Dec. 22, 2008

(65) Prior Publication Data

US 2010/0154978 A1 Jun. 24, 2010

(51) Int. Cl.
*A01B 29/00* (2006.01)

(52) U.S. Cl. ..... 492/28

(58) Field of Classification Search ..... 492/38, 492/33–34, 28

See application file for complete search history.

(56) References Cited

U.S. PATENT DOCUMENTS 3,436,245 A * 4/1969 Grundman ..... 428/89
3,591,401 A * 7/1971 Snyder ..... 428/88
3,959,464 A * 5/1976 DeSavigny ..... 514/131
4,083,326 A * 4/1978 Kroll et al. ..... 399/281
4,408,862 A * 10/1983 Takano et al. ..... 399/286
4,444,864 A * 4/1984 Takahashi ..... 430/122.8
5,438,728 A * 8/1995 Kubes et al. ..... 15/180
2001/0022910 A1* 9/2001 Sawayama ..... 399/353
2007/0147906 A1* 6/2007 Sakurai et al. ..... 399/286

FOREIGN PATENT DOCUMENTS

JP 08160819 A * 6/1996
JP 10108735 A * 4/1998

* cited by examiner

*Primary Examiner* — David Bryant
*Assistant Examiner* — Jacob Cigna
(74) *Attorney, Agent, or Firm* — Justin M Tromp

(57) ABSTRACT

A method for controlled installation of a brush filament population on a shaft for making a toner adder brush roller includes applying a layer of adhesive over a surface of a roller shaft, applying a template over at least a portion of the shaft surface, and flocking a multiplicity of filaments on the shaft surface to provide a brush on the roller shaft having a filament population controlled by the application of the template. The method also includes removing the template from the shaft surface after flocking the multiplicity of filaments such that a set of filaments less than the multiplicity of filaments is removed with the template. The method further includes flocking additional filaments on the portion of the shaft surface after removing the template from the portion of the shaft surface, the additional filaments differs from said previously flocked filaments in one of material, length, denier, or combinations of the foregoing.

11 Claims, 2 Drawing Sheets

TONER ADDER BRUSH ROLLER AND METHOD FOR CONTROLLED INSTALLATION OF BRUSH FILAMENT POPULATION

BACKGROUND

1. Field of the Invention

The present invention relates generally to toner cartridge systems, such as used in laser printers and the like, and, more particularly, to a toner adder brush roller and method for controlled installation of a brush filament population on a shaft of a toner adder brush roller.

2. Description of the Related Art

A toner adder roller, also know as a toner supply roller, is the first item of hardware that toner encounters in a conventional laser printer toner cartridge. The toner adder roller is made from a conductive foam which is compressed against a harder developer roller. The developer roller and toner adder roller rotate and form a nip between one another. The role of the toner adder roller in the cartridge is two-fold: as a first mechanism, applying fresh toner onto the developer roller; and, as a second mechanism, removing old toner from the developer roller surface. Both mechanisms have electrostatic charge and mechanical attributes.

The toner adder roller has been identified as one factor contributing to toner starvation in toner cartridges which ultimately leads to failure of a laser printer toner cartridge system. One theory is that starvation occurs when the toner adder roller cannot sufficiently supply the developer roller with fresh toner.

The toner starvation issue continues to pose a substantial problem and is only likely to become more pressing in view of the future need in the market for higher print speeds and for cartridges that have longer print life. The increased torque generated at higher speeds in combination with a longer cartridge life will only increase the toner starvation issue. In addition, the faster print speeds will require more strain on the power train and will also generate more heat in the cartridge. All these effects mentioned above are expected to have negative impact on the print quality and to the cartridge itself.

An alternative toner adding hardware item has been proposed in the past, a toner adder brush roller, also known as a toner supply brush roller. U.S. Pat. No. 4,083,326 discloses an "electrically conductive fur brush" roller loaded with brush materials made of natural and synthetic fibers, and also made of fibers extruded and containing conductive particles such as carbon. Thus, instead of attaching a conductive foam cylinder onto a shaft as done in making the toner adder roller, a toner adder brush roller may be made by loading and adhering conductive filaments or fibers perpendicularly to the shaft. This can be done by two processes: wrapping a woven 'velvet' strip around the shaft or fixating the filaments directly onto the shaft through a flocculation process.

The toner adder brush roller possesses a number of characteristics that make it appear to be a potential solution to the toner starvation problem encountered by the toner adder roller. The softer nature of the filaments noticeably reduces the torque in the toner adder brush roller/developer roller nip, compared to a system utilizing the toner adder roller. The greatly increased surface area also has the potential to improve the capability of the toner adder brush roller to charge triboelectrically compared to the toner adder roller, since triboelectric charge is a surface phenomenon.

However, the flocked and the woven toner adder brush roller each possess a unique set of characteristics that may lead either to severe print quality defects or to system failure.

In the case of the flocked toner adder brush roller and depending on the toner, the toner that ends up between the densely populated toner adder brush roller filaments cannot get back out. Consequently, toner packing occurs with the result that the flocked toner adder brush roller is essentially transformed into a solid cylinder. In the case of the woven toner adder brush roller, wherein a woven fabric is cut into bands and wrapped around and adhered to the shaft in a spiral configuration, wrap pattern print defects occur as a function of the gap formed between the fabric edges. Thus, there is a need to find a toner adder brush configuration that combines the wanted characteristics of each existing version while eliminating the properties that cause problems.

As a result, there is a need for an innovation that will overcome the above-mentioned defects for providing a solution to the toner starvation problem encountered by laser printer toner cartridge systems.

SUMMARY OF THE INVENTION

The present invention meets this need by providing an innovation that substantially overcomes the above-mentioned drawbacks of toner packing and/or wrap pattern print defects in flocked and woven toner adder brush rollers by combining the flocked and woven configurations of toner adder brush rollers to provide an enhanced toner adder brush roller which will, in turn, substantially overcome the toner starvation problem. The toner packing problem is believed to be based on inadequate filament interspacing within the flocked filament population on the shaft of the toner adder brush roller over the surface of the shaft. Poor filament interspacing and lack of population control are a direct result of the shortcomings of the flocculation process itself. Although the flocculation process is self-terminating, it does not ensure an adequate number of filaments in the filament population. The innovation of the present invention contributes to a controlled installation of a filament population on the shaft for making the enhanced toner adder brush roller. In addition, with the process described herein, it is believed that a controlled mix of two or more different filament sets to be fixed on the brush roller shaft surface can be achieved. The difference between the filament populations can be in the type of material, in physical or electrical characteristics (denier variations and/or length variations) or in combinations of these.

Accordingly, in an aspect of the present invention, a method for controlled installation of a brush filament population on a roller shaft for making a toner adder brush roller comprises applying a template over at least a portion of the shaft surface, applying a layer of adhesive over a surface of a roller shaft and template, removing the template from the shaft surface and flocking a multiplicity of filaments on the shaft surface to provide a brush on the roller shaft having a filament population controlled by the application of the template. The method also includes removing the template from the shaft surface after flocking the multiplicity of filaments such that a set of filaments less than the multiplicity of filaments is removed with the template. The method further allows for flocking additional filaments on the portion of the shaft surface after removing the template from the portion of the shaft surface.

In another aspect of the present invention, a toner adder brush roller includes a shaft made from or plated with a suitable electrically-conductive metal adapted to support an electric field, a layer of adhesive coating the surface of said shaft, and a multiplicity of filaments flocked on and attached to the layer of adhesive on the shaft so as to provide a filament population controlled by a template applied over the shaft.

The filaments are adapted to support a bipolar arrangement of electrical charge. The electric field of the shaft induces the bipolar arrangement of charge in the filaments causing the attached filaments to be electrically oriented relative to the electric field of the shaft.

BRIEF DESCRIPTION OF THE DRAWINGS

Figure 1:
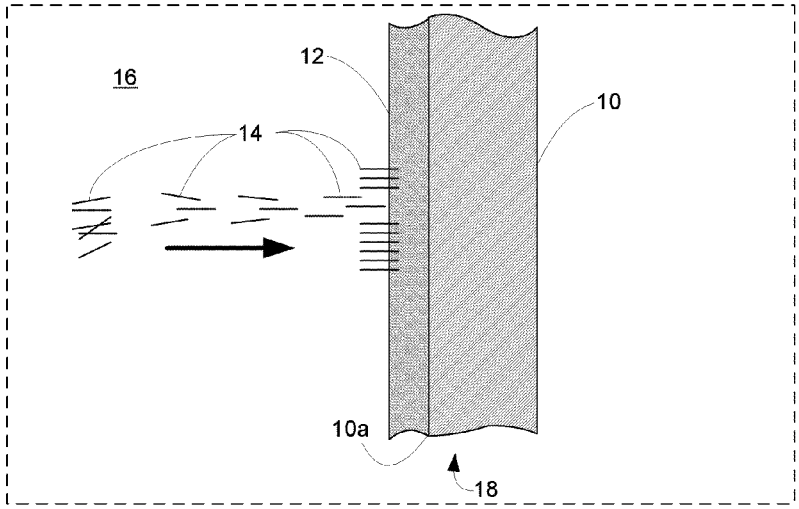
Fig. 1 Prior Art
Figure 2A:
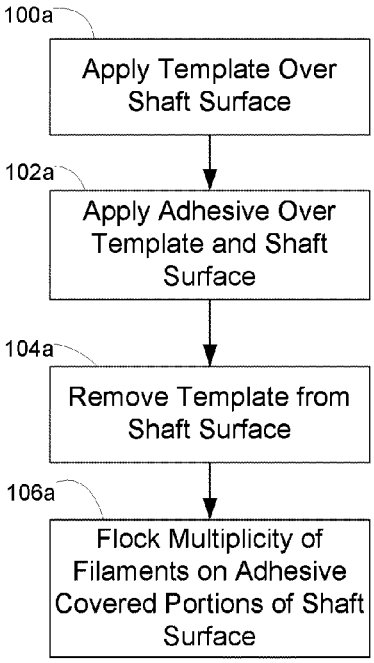
Figure 2B:
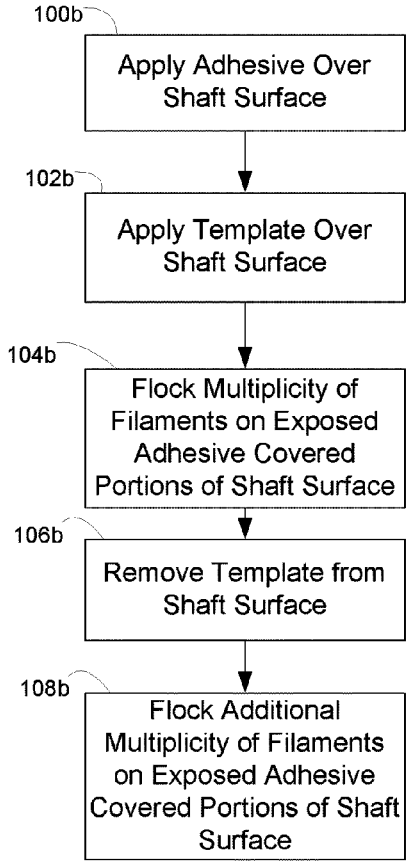
Figure 3:
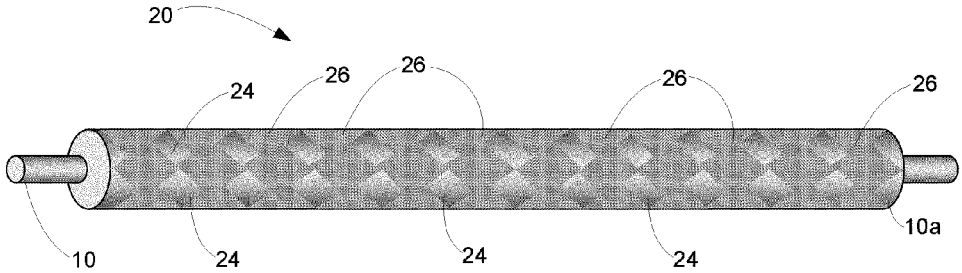

Having thus described the invention in general terms, reference will now be made to the accompanying drawings, which are not necessarily drawn to scale, and wherein:

FIG. 1 is a simplified enlarged schematic representation of a prior art flocculation process for planting filaments on a conductive shaft for making a prior art toner adder brush roller;

FIG. 2*a* is a block diagram of a method for controlled installation of a filament population on a shaft for making an enhanced toner adder brush roller in accordance with the present invention;

FIG. 2*b* is a block diagram of an alternate method for controlled installation of a filament population on a shaft for making an enhanced toner adder brush roller in accordance with the present invention;

FIG. 3 is an exemplary embodiment of an enhanced toner adder brush roller of the present invention made by the method of FIG. 2*a;*

Figure 4:
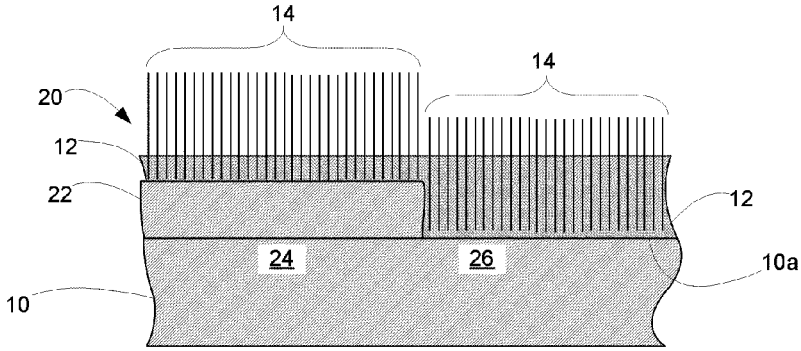
Figure 5A:
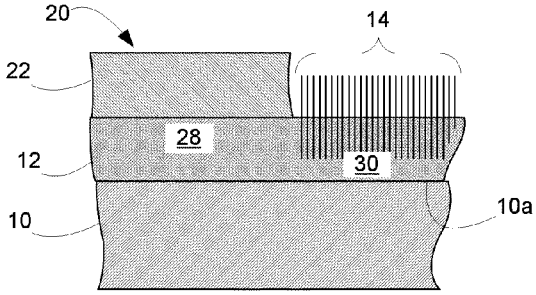
Figure 5B:
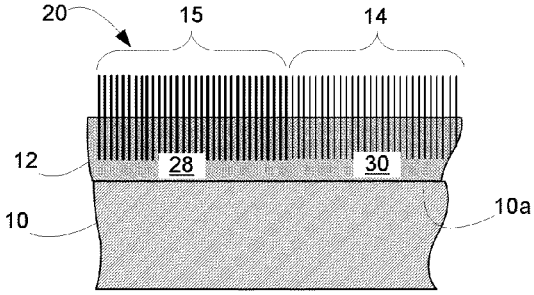

FIG. 4 is a fragmentary schematic representation of an exemplary embodiment of the toner adder brush roller after filament flocculation on to the adhesive layer but prior to removal of an exemplary template that had been applied over the surface of the shaft in accordance with the method described in FIG. 2*a*; and FIG. 5*a* is a fragmentary schematic representation of an exemplary embodiment of the toner adder brush roller after a first flocculation of filaments on the adhesive layer where an exemplary template had been applied over the adhesive layer on the surface of the shaft of the enhanced toner adder brush roller in accordance with the method described in FIG. 2*b*; and FIG. 5*b* is a fragmentary schematic representation of an exemplary embodiment of the toner adder brush roller after the exemplary template had been removed and a second flocculation of different filaments has been applied to the adhesive layer that had been covered by the template in accordance with the method described in FIG. 2*b*.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Basically, as shown in the simplified schematic representation of FIG. 1, a prior art flocculation process, also known as "electrostatic planting" or "flocking", is carried out by applying an electric field to an electrically-conductive shaft 10. The conductive shaft 10 is made from or plated with a suitable electrically-conductive metal, such as nickel, cobalt, copper and the like. As described herein shaft 10 is cylindrical with a circular cross-section. With the process disclosed herein, it is expected that shafts having other cross-section shapes such as square, triangular, rectangular could also be used. The surface 10*a* of the shaft 10 is pre-coated with a non-cured adhesive layer 12. Conductive filaments 14 to be planted or flocked onto the adhesive layer 12 of the shaft 10 are pre-cut to a final length and surface treated to act as a non-conductive material. The electrically-conductive shaft 10 and the filaments 14 are placed in a fluid medium 16 indicated by the dashed line box, such as a gas, air or the like, located within the electric field applied to the shaft 10. The electric field induces a bipolar charge in the filaments 14, causing them to turn the end with opposing charge relative to the charge of the shaft 10 and toward the shaft 10. The filaments 14 will move through the fluid medium 16 and land on the shaft 10 and plant into the adhesive layer 12 in a perpendicular (or radial) orientation relative to the shaft surface 10*a*. The adhesive layer 12 on the shaft surface 10*a* fixes the filaments 14 to the shaft 10 thus ensuring that the filaments 14 do not repel from the shaft 10. It will be realized that the flocked filaments will be radially aligned on the curved surface of the shaft.

While the flocculation process is a self-terminating process, it will not ensure a homogeneous population of filaments 14 on the shaft 10 until the flocking is complete, that is, when each vacant site on the shaft 10 has been populated and filament packing has reached its maximum. The flocculation process has another limitation: flocculation is easier to carry out the shorter the cut filaments 14 are. Longer filaments have a larger probability of rubbing against each other while moving in the fluid medium 16 towards the shaft 10. This will adversely affect the alignment of the filaments 14 on the shaft 10. So for a given population of filaments it is important to cut the filaments 14 to the desired length; the more homogeneous the filament population is regarding length, the more homogeneous will be the diameter of the finished toner adder brush roller 18 in those areas where those filaments are used.

FIGS. 2*a*, 3, and 4 respectively illustrate a block diagram of a method for controlled installation of a filament population on the shaft 10 and an enhanced toner adder brush roller 20 made by the method, both in accordance with the present invention. Since the flocculation process would terminate when filaments 14 have been completely packed (or fully populated) over the entire shaft surface 10*a*, it appears possible to control filament population per unit of toner adder brush roller shaft surface area (# filaments/shaft unit area) by selecting and controlling the areas on the surface 10*a* of the shaft 10 where the adhesive layer 12 will be applied. Therefore, an embodiment of the method for making the enhanced toner adder brush roller 20 includes the steps of: as per block 100*a*, applying the template 22 over the surface 10*a* of the shaft 10 to cover at least a first portion 24 of the surface 10*a* of the shaft 10 and leave a second portion 26 of the shaft surface 10*a* exposed; as per block 102*a*, applying the adhesive layer 12 over the template 22 and exposed second portion 26 of the shaft surface 10*a*, as per block 104*a*, removing the template 22 from the shaft 10, and as per block 106*a*, flocking a multiplicity of filaments 14 in the adhesive coated exposed second portion 26 of the shaft surface 10*a* by utilizing the flocculation process depicted in FIG. 1. As can be seen in FIG. 3, the toner adder brush roller 10 has first portions 24 that do not contain any filaments and second portions 26 that are populated by a multiplicity of filaments 14.

As illustrated in FIGS. 2*b*, 5*a* and 5*b*, an alternate embodiment of the method for making the enhanced toner adder brush roller 20 includes the steps of: as per block 10*b*, applying the adhesive layer 12 to the shaft surface 10*a*, as per block 102*b*, applying the template 22 over the adhesive layer 12 covering at least a first portion 28 of the adhesive layer 12 while leaving a second portion 30 of the adhesive layer exposed, as per block 104*b*, flocking a multiplicity of filaments on the exposed second portions of the adhesive layer 12, as per block 106*b*, removing the template 22 from the shaft surface 10*a* to expose the first portion 28 of the adhesive layer 12, and, as per block 108*b*, flocking an additional multiplicity of filaments 14 on the exposed first portion 28 of the adhesive layer 12.

As shown in FIG. 5*b* filaments 15 have been flocked onto portions 28 of the adhesive layer. Filaments 15 can be the same as type as filaments 14 but have a different length or denier than filaments 14 or can be of a different type, and/or length and/or denier. The shaft will likely have to be populated to the maximum, meaning no open sites remaining as each portion of the adhesive layer is exposed to the filaments of a given type. However, the filaments 14 may be flocked onto the entire shaft 10 but will only adhere to the areas of the shaft 10 where adhesive layer 12 is applied, thus creating an enhanced toner adder brush roller 20 with a lower filament population count. This method may be extended to include several additional sets of filaments 14 or 15.

The filaments 14, 15 may be made by a well-known spinning process as a long continuous filament thread and wrapped around a large wheel (like a roll of thread) to facilitate handling thereof. To use the filament to make a flocked brush roller, the long continuous filament is cut into very precise and very short sections. The filament is unwrapped from the wheel into a large skein, which in turn is twisted hard, clamped down, and cut into small and very precise sections. In other words, all of the small filaments were initially from a long strand. Finally, the filaments are pre-treated to ensure that they do not act as if they are conductive. If they are conductive, the filament will not act as a dipole and will not align properly to the electrical field.

In the above-described steps of the method, there are several alternative ways to control the placement of the filament population on the surface 10*a* of the toner adder brush roller shaft 10. Desired filament-free 24 areas may be created across the shaft surface 10*a* by selectively locating the adhesive layer 12 on the roller shaft 10 using one or more of these techniques: (a) by printing the adhesive layer 12 in a controlled pattern over the shaft 10; (b) by spraying the adhesive layer 12 in a controlled pattern over the shaft 10; or (c) by applying the template 22 over the shaft 10 either before or after the printing or spraying. The template 22 will enable the adhesive layer 12 to be applied in a controlled pattern over the shaft 10. The template 22 may be removed either after the application of the adhesive layer 12 is complete or after the flocculation process has been completed. Also, the template 22 may not be removed. This would not permit application of a second set of filaments as the template 22 will be part of the finished enhanced toner adder brush roller 20. In some instances, the template and shaft are coated in a second layer of adhesive. In addition, the technique as described in (c) above may enable construction of an enhanced toner adder brush roller 20 with a homogeneous flocked filament blend configuration. A possible benefit where the template 22 is coated with the adhesive layer 12 is that the filaments 14 that do not hit an exposed section of the shaft 10 will still be attached perpendicularly to the shaft 10, but on the template 22 (see FIG. 4). This mechanism may minimize the amount of filaments 14 that will repel against the shaft/template surface and thus travel (be thrown) back into the electrical field. Repelled filaments may disturb the alignment of filaments traveling through the electrical field towards the shaft 10, thereby increasing the risks of a poorly aligned filament population on the finished toner adder brush roller 20.

If the template 22 is not removed from the shaft 10, then variation in height of the filaments 14 can be achieved by using of the thickness of the template 10 itself, allowing for filaments of one given length to have at least two different heights when flocked and adhering to the toner adder roller brush 20 as illustrated in FIG. 4. Further if the template 10 is made in a manner such that its thickness is variable over its area then the height of the filaments adhering there will vary in the same manner. It is contemplated that the template may also contain regions of constant thickness and regions of variable thickness. The variable thickness can be achieved in a step-wise fashion such that the lower surfaces are level but parallel to the outer surface of the template or by using concavities or convexities or concavoconvexities or combinations thereof. The outer surface of the template is the surface away from the shaft surface while the inner surface of the template is the surface that faces or is adjacent to the shaft surface. It would be expected that where concavities, convexities or concavoconvexities are used the filaments flocked on to those areas will not be radially aligned to the filaments flocked onto the shaft surface or the regions of constant thickness of the template.

The differences between the filaments 14 that may be flocked onto the same shaft 10 include, but are not limited to, material including chemical and electrical properties thereof, filament length and denier. The above-described method is applicable to filaments 14, 15 having a wide range of synthetic chemical compositions, such as acrylic, PU, nylon and the like, and of filament properties and configurations, such as denier range, shape, resistance level and the like. An exemplary embodiment of a filament population is in the range of about 15 KF to 150 KF (1 KF=1000 filaments/in.$^2$) for a six denier filament (1 denier=1 g/9000 m). The filament surface may also be chemically treated to help achieve the desired properties.

FIGS. 4 and 5*a* illustrate exemplary embodiments of fragmentary sections of the template 22 respectively under and over the adhesive layer 12. The template 22 should ideally be reusable (thus should be sturdy but flexible) and may, for example, be made from metal, polymer, or paper. However, the template 22 usually is not reusable when it has been applied under the adhesive layer 12. The template 22 should not cut off the electrical field generated around the shaft 10 or the flocculation process may get disturbed diminishing the functionality of the finished toner adder brush roller 20. The pattern of the template 22 may be designed in a number of different ways, for example, contain slots (which includes holes and the like), aligned in a pattern, such as a cubic or diamond pattern as shown in FIG. 3. The pattern may be etched on or punched out of a continuous sheet of template material. It may also be possible to mold a template precursor into a pattern. Lastly, the template 22 (and therefore also the pattern) may be oriented in any angle with respect to the shaft 10.

Using the method of the present invention other variations are possible. Different filaments 14, 15 may be placed at different locations along the length of the shaft or core, such as one filament type near each end and another type in the center, although a homogeneous population over the entire shaft surface 10*a* is preferred. Also, the filaments 14 may be alternated like stripes along the length of the shaft 10. Also, the stripes may spiral about the shaft 10. Further, combinations of these may be used, a pattern of stripes in one region and a different pattern in another region. Also, the filament length may vary in different areas or a combination of filament lengths may be used in a given area. The filaments 14 preferably are perpendicular to the shaft surface 10*a* although they may be angled or in a more random, tangled or matted pattern, if desired.

The adhesive may be either conductive or non-conductive. It also needs to be sticky (higher viscosity) so that it fixes the filament to the shaft 10 as soon as the filament hits the adhesive surface, in view that the shaft 10 will repel the filament as soon as it hits the surface. At the same time, the adhesive needs to be kept at a viscosity that ensures a thin and homogeneous thickness over the shaft 10. The filament does not have to penetrate through the adhesive layer 12 all the way to the shaft surface 10*a* in order to ensure a conductive path between the shaft and filament ends. The most cost effective adhesive to use is a non-conductive hot-melt adhesive (however a conductive hot-melt adhesive may also be used). A hot-melt adhesive can be applied to the shaft surface 10*a*, let cool down and harden, get heated up again (activated) and fixed to the other surface (the filament), to finally be cooled down again (cured). As long as the shaft temperature in the cartridge when it is operating in the printer does not exceed the adhesive re-activation temperature, the hot-melt adhesive works effectively.

In summary, the present invention is directed to a controlled method of installing a brush filament population on a shaft for making an enhanced toner adder brush roller having an improved filament population density and placement controlled by the application of a template. The problem solved is that print quality is improved due to reduced toner starvation, improved toner charge consistency, and reduced heat generation in view that torque is reduced. The use of the toner adder brush roller potentially will improve print quality performance and reduce system torque thus further enabling printers to go to higher speeds.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A toner adder brush roller, comprising:

a shaft made from or plated with a suitable electrically-conductive metal adapted to support an electric field;

a layer of adhesive coating the surface of said shaft; and a multiplicity of brush filaments flocked on and attached to said layer of adhesive on said shaft so as to provide at least a first filament population and a second filament population, the filaments of the first filament population differing from the filaments of the second filament population in at least one of height and type, each of said filaments supporting a bipolar arrangement of electrical charge, said electric field of said shaft inducing the bipolar arrangement of charge in said each filament causing said attached filaments to be electrically oriented relative to said electric field of said shaft.

2. The roller of claim 1 wherein said filaments of the first and second filament populations are pre-cut to a final length before attachment to said layer of adhesive.

3. The roller of claim 1 wherein said filaments of the first and second filament populations are surface treated, to act as a non-conductive material, before attachment to said layer of adhesive, to support said bipolar arrangement of electrical charge.

4. The roller of claim 1 wherein said layer of adhesive is a hot-melt adhesive.

5. The roller of claim 1 wherein said filaments of the first and second filament populations are of a synthetic chemical composition.

6. A toner adder brush roller, comprising:

a shaft comprising electrically-conductive metal adapted to support an electric field;

a layer of adhesive coating the surface of said shaft; and a multiplicity of brush filaments flocked on and attached to said layer of adhesive on said shaft so as to provide at least a first filament population and a second filament population, the second filament population differing from the first filament population by at least one of material, length, or denier, each of said filaments supporting a bipolar arrangement of electrical charge, said electric field of said shaft inducing the bipolar arrangement of charge in said each filament causing said attached filaments to be electrically oriented relative to said electric field of said shaft.

7. The toner adder brush roller of claim 6 further comprising a template applied over said adhesive layer covering at least one portion of the adhesive layer of the shaft.

8. The toner adder brush roller of claim 6 further comprising a template applied to the surface of the shaft under said adhesive layer, wherein said template covers a first portion of the shaft surface and includes one or more slots therethrough positioned over a second portion of the shaft surface, the template forming part of the toner adder brush roller under the brush filaments.

9. The toner adder brush roller of claim 8 wherein said template has a variable thickness over its surface.

10. The toner adder brush roller of claim 8 wherein the template has a constant thickness over its surface.

11. The toner adder brush roller of claim 8 wherein the applied template has at least one region of constant thickness and at least one second region of variable thickness over its surface.

* * * * *